US007688199B2

(12) United States Patent
Zhang et al.

(10) Patent No.: US 7,688,199 B2
(45) Date of Patent: Mar. 30, 2010

(54) SMOKE AND FIRE DETECTION IN AIRCRAFT CARGO COMPARTMENTS

(75) Inventors: Wei Zhang, Bothell, WA (US); Chao-Hsin Lin, Redmond, WA (US)

(73) Assignee: The Boeing Company, Chicago, IL (US)

( * ) Notice: Subject to any disclaimer, the term of this patent is extended or adjusted under 35 U.S.C. 154(b) by 589 days.

(21) Appl. No.: 11/555,992

(22) Filed: Nov. 2, 2006

(65) Prior Publication Data

US 2008/0106437 A1 May 8, 2008

(51) Int. Cl.
*G08B 1/08* (2006.01)
*G08B 21/00* (2006.01)
*G08B 25/00* (2006.01)

(52) U.S. Cl. ..... 340/539.26; 340/525; 340/506; 340/517; 340/521; 340/945; 700/17; 702/1

(58) Field of Classification Search ..... 340/539.26, 340/525
See application file for complete search history.

(56) References Cited

U.S. PATENT DOCUMENTS 5,432,895 A * 7/1995 Myers ..... 345/419
5,557,260 A 9/1996 Legaz et al.
6,529,132 B2 3/2003 Boucourt
6,696,958 B2 2/2004 Anderson
7,002,478 B2 * 2/2006 Moore et al. ..... 340/577
2003/0187621 A1 * 10/2003 Nikitin et al. ..... 702/189
2003/0214583 A1 11/2003 Sadok
2003/0215141 A1 11/2003 Zakrzewski et al.
2003/0215143 A1 11/2003 Zakrzewski et al.
2004/0143602 A1 * 7/2004 Ruiz et al. ..... 707/104.1
2004/0213320 A1 10/2004 Bobenhausen
2005/0012626 A1 1/2005 Owrutsky et al.
2005/0270150 A1 12/2005 Freiling et al.

OTHER PUBLICATIONS

D. Blake; "Aircraft Cargo Compartment Fire Detector Certification"; FAA Technical Center; Atlantic City, NJ; Oct. 22-25, 2001; (28 pages).

FAA Advisory Circular; "Certification of Transport Airplane Mechanical Systems"; AC-25-22; Mar. 14, 2000; (16 pages).

National Transportation Safety Board; "Smoke Detection Penetration, and Evacuation Test and Related Flight Manual . . . "; FAA Advisory Circular 25-9A, Jan. 6, 1994 (30 pages).

(Continued)

*Primary Examiner*—Donnie L Crosland
(74) *Attorney, Agent, or Firm*—Haynes and Boone, LLP

(57) ABSTRACT

A detection system may include at least one sensor located in an enclosable space, each sensor being configured to detect at least one environmental feature and provide a corresponding at least one environmental feature signal. The system may process the at least one environmental feature signal and provide at least one processed feature signal, the at least one processed feature signal corresponding to a transformed at least one environmental feature signal. The system may further provide a hosted function configured to provide instructions for processing, the hosted function comprising a computational algorithm adapted to perform numerical transformation operations based on the at least one environmental feature signal, the hosted function being configured to provide a map image based on the at least one processed feature signal.

23 Claims, 5 Drawing Sheets

OTHER PUBLICATIONS

W. Krull; "Design and Test Methods for a Video-Based Cargo Fire Verification System for Commercial Aircraft"; Fire Safety Journal, vol. 41; Dec. 15, 2004 (11 pages).

NASA; "Where there's Smoke, There's Not Always Fire: A New Approach to Fire Detection"; htp://www.grc.nasa.gov/WWW/5000/featuredtech/firedetect.htm; Sep. 15, 2006; (2 pages).

J. Xu; "Cargo Hold Fire Detection Technology"; International Aircraft Systems Fire Protection Group Meeting; Atlantic City, NJ, Nov. 1-2, 2005; (27 pages).

D. Gottuk; "Advanced Fire Detection Using Multi-Signature Alarm Algorithms"; Fire Safety Journal 37, Mar. 2000; (14 pages).

A. Pfefferseder; "Requirements to Gas Sensors in Fire Alarms for Residential Use"; 12th International Conference on Automatic . . . ; AUBE 01, NIST; Mar. 25-28, 2001; (9 pages).

A. Freiling; "New Approaches to Aircraft Fire Protection"; 12th International Conference on Automatic Fire Protection; AUBE 01, Mar. 25-28, 2001; 14 pages).

M. Giles; "An Introduction to the Adjoint Approach to Design", Flow Turbulence and Combustion 65, Kluwer Academic Publishers; pp. 393-415; Feb. 2000.

J. Smagorinsky; "General Circulation Experiment s with the Primitive Equations: I the basic Experiment"; Monthly Weather Review, vol. 91; Mar. 1963; (10 pages).

J. Deardorff; "A Numerical Study of Three-Dimensional Turbulent Channel Flow At Large Reynolds Numbers"; J. Fluid Mech., vol. 41; May 9, 1969.

S. Pope; "Turbulent Flows"; Cambridge University Press; 2000; pp. 303-304, 365-375.

T. Cebeci and A. Smith; "Analysis of Turbulent Boundary Layers"; Academic Press; 1974; pp. 91, 104-112.

Q. Chen and L. Glicksman; "Simplified Methodology to Factor Room Air Movement and the Impact on thermal Comfort into . . . "; ASHRAE RP-927; pp. 1, 3, 15-17; Mar. 22, 1999.

J. Srebric and Q. Chen; "Validation of a Zero-Equation Turbulence Model for Complex Indoor Airflow Simulation"; ASHRAE Transactions, vol. 105; pp. 1-14; 1999.

Q. Chen and J. Srebric; "A Procedure for Verification, Validation, and Reporting of Indoor Environment CFD Analyses"; HVAC & R Research, vol. 8; pp. 201-216; Apr. 2002.

C. Scheidegger et al.; "Practical CFD Simulations on Programmable Graphics Hardware . . . "; Published at TechRepublic; http://whitepapers.techrepublic.com; Aug. 2004; (15 pages).

* cited by examiner

SMOKE AND FIRE DETECTION IN AIRCRAFT CARGO COMPARTMENTS

TECHNICAL FIELD

The present invention relates generally to smoke and fire detection, and more particularly to systems and methods for detecting smoke and fire in aircraft cargo compartments.

BACKGROUND

Smoke detection systems in aircraft cargo compartments have historically experienced a high incidence of false alarm rates. Some smoke detection systems used in aircraft cargo compartments consist of a network of "spot-type" smoke detectors coupled with an alarm system. The network of detectors sends alarm status signals to the alarm system, which provides a warning signal to the flight deck, where a decision may take place to initiate fire suppression and other safety systems. Other proposed smoke detection systems may employ video cameras.

The existence of "particulates" such as mist, dust, condensation, oil droplets and other aerosols in the cargo hold compartments and the sensitivity of current sensor systems contribute to the "high" false alarm rates. In some cases, the ratio of false to genuine alarms may reach 200:1. One study of verified smoke events vs. total alarms indicates that over 90% of all alarms are false due to these particulates. The direct cost of each false alarm may exceed $50,000 and may include indirect consequences such as (1) increased safety risk due to forced landings at unfamiliar or less adequate airports, (2) loss of confidence in detection systems, and (3) risk of injury to passengers and crewmembers during evacuation.

Accordingly, a need exists in the art for improved techniques for smoke and fire hazard detection and evaluation.

SUMMARY

Systems and methods are disclosed for providing detection and evaluation of fire hazards in enclosable spaces. For example, one or more embodiments of the invention may provide a fire and/or smoke hazard modeling algorithm of numerical sensor data processing (NSDP) based on computational fluid dynamics (CFD) technology that is operational on a high speed computing system capable of interfacing with a multi-sensor system to process the sensor data in real-time and display the processed information graphically.

More specifically, in accordance with an embodiment of the invention, a detection system may include at least one sensor located in an enclosable space, each sensor being configured to detect at least one environmental feature and provide a corresponding at least one environmental feature signal; means for processing the at least one environmental feature signal and providing at least one processed feature signal, the at least one processed feature signal corresponding to a transformed at least one environmental feature signal; a hosted function configured to provide instructions to the processing means, the hosted function comprising a computational algorithm adapted to perform numerical transformation operations based on the at least one environmental feature signal, the hosted function being configured to provide a map image based on the at least one processed feature signal; and a means for displaying the map image.

In accordance with another embodiment of the invention, a method for communicating environmental information of an enclosable space to a flight crew in the cockpit of an aircraft may include providing at least one sensor, each sensor being configured to detect at least one environmental feature and provide a corresponding at least one environmental feature signal, each sensor being disposed at a location in the enclosable space; providing a hosted function including at least one processing instruction; processing the at least one environmental feature signal based on the at least one processing instruction from the hosted function to provide a map image representation; and displaying the map image representation. The hosted function is configured to implement a computational algorithm comprising transforming the first environmental feature signal to create a first map image representation of the environmental feature signal; providing at least one prediction parameter for each environmental feature signal, each prediction parameter being used to provide a predicted map image representation according to a computational fluid dynamics algorithm processing of the at least one environmental feature signal at a time increment; transforming a second environmental feature signal by the at least one sensor after the time increment to create a second map image representation of the environmental feature signal related to the time increment; updating the first map image representation of the environmental feature to a second map image representation; and determining at least one error difference between the second map image representation and the predicted map image representation, the at least one error difference being used to update the computational fluid dynamics algorithm processing.

In accordance with yet another embodiment of the invention, a method of hazard sensing in an enclosable space may include determining the presence of a hazardous condition by using a numerical sensor data processing algorithm based on computational fluid dynamics configured to process a detected signal from at least one sensor disposed in the enclosable space; creating a map image providing at least a current representation and a predicted future representation of the hazardous condition based on the numerical sensor data processing algorithm; and displaying the map image on a display.

The scope of the invention is defined by the claims, which are incorporated into this section by reference. A more complete understanding of embodiments of the invention will be afforded to those skilled in the art, as well as a realization of additional advantages thereof, by a consideration of the following detailed description. Reference will be made to the appended sheets of drawings that will first be described briefly.

BRIEF DESCRIPTION OF THE DRAWINGS

Embodiments of the invention and their advantages are best understood by referring to the detailed description that follows. It should be appreciated that like reference numerals are used to identify like elements illustrated in one or more of the figures.

DETAILED DESCRIPTION

Figure 1:
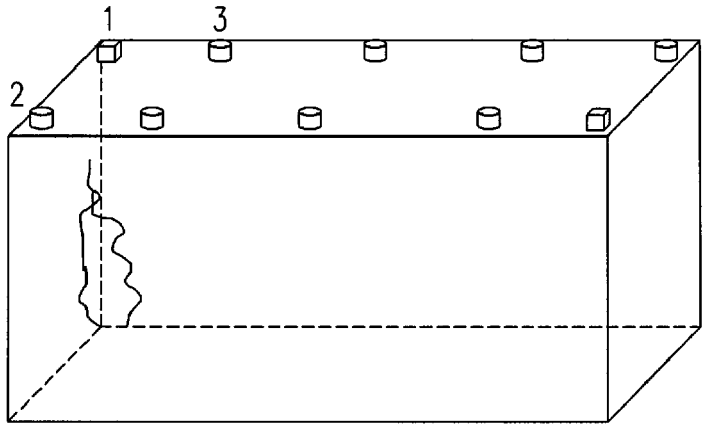
FIG. 1 shows an exemplary smoke and fire multi-sensor array in an enclosable space, in accordance with one or more embodiments of the invention.

In accordance with one or more embodiments of the invention, smoke and fire detection systems are disclosed for enclosable compartments of vehicles and structures (e.g., cargo and storage space in aircraft, marine or ground vehicles, or buildings, and tunnels), to provide monitoring of combustion by-products associated with fire hazards, the systems and methods may reduce false alarms and provide a better prediction of the time evolution of fire hazards relative to some conventional approaches. For example, because a cargo hold may typically be equipped with "spot-type" sensors, such as a smoke detector, it would be advantageous to provide a practical array of these and other types of sensors, configured in the enclosable space to take readings that may provide for a more accurate indication of hazardous conditions, based on measurement of more varied properties. For example, a multi-sensor system may include one or more sensors for detection of smoke, combustible gas products, such as CO and $CO_2$, temperature, and visual fire artifacts. Thus a multi-sensor system may be advantageous, particularly when used with signal processing software in discriminating between real and false alarms. An array, meaning one or more of such sensors, may be disposed in a one, two, or three dimensional pattern throughout the cargo space.

Given a finite, limited number of sensors, and various regular and/or irregular placement of the sensors providing a limited sensor output, one or more embodiments of the invention may provide for the calculation and/or display of hazard information in reference to a two dimensional map of a sensor plane (i.e. a ceiling), or a three dimensional map of a sensor space (i.e. a compartment volume). Since aircraft computer and data communications systems are becoming more sophisticated with the introduction of newer aircraft, it may be beneficial to take advantage of these computer and communications architectures in a novel manner to access and process sensor data for fire detection and suppression measures.

Because CFD-based computation may be highly parallel in computational architecture, and the multi-sensor system may be treated as highly parallel in structure, it may be advantageous to employ computing hardware that is adapted for this type of problem. Numerical sensor data processing (NSDP) provides a system and method in accordance with an embodiment of the invention that combines multi-sensor systems, parallel processing software and parallel processing computing hardware platforms to satisfy this need.

One type of computer system that may be used is a graphical processing unit (GPU). The GPU may be a highly parallel structure processor on a card with random access memory (RAM) dedicated to supporting GPU processes. The GPU may be a dedicated graphics rendering device that has been developed for personal computers and game consoles, and may be employed as an element of a computer processing system. Modern GPUs are very efficient at manipulating and displaying computer graphics, and their highly parallel structure may make them more effective than conventional central processing units (CPUs) for a range of complex algorithms required in real-time in addition to graphics. This makes them attractive for data manipulation, especially in two or three dimensions, beyond the mere presentation of vivid graphics. Furthermore, GPUs are readily available on high performance graphics cards compatible with personal computers at a cost of only a few hundred dollars. Alternatively, an equivalent high-speed graphic image rendering computing engine or coprocessor may be used.

By adapting numerical computational methods to the capabilities of sensors, on-board computer and data communications systems, it may be beneficial to enable an effective level of real time evaluation of fire hazards and a prediction of the fire's smoke, gas and heat evolution to properly assess and mitigate the danger. Thus, GPUs may be an excellent choice for processing CFD algorithms substantially in real time at modest cost.

FIG. 1 shows an exemplary smoke and fire multi-sensor array, as may be disposed in the cargo space of an aircraft, according to one or more embodiments of the invention. A plurality of sensors may be configured in an array distributed about the cargo compartment. For example, sensor 1 may be a smoke, $CO_2$ or temperature sensor. The presence of a hazard detected by sensor 1 will be processed by an algorithm, herein referred to as a hosted function software application, or hosted function. According to one or more embodiments of the invention, the hosted function may be the NSDP. The NSDP may be a CFD algorithm, and it may run on a computational processing platform, which may be a GPU.

The sensor signal may be transformed by the NSDP, and an initial smoke concentration and/or fire intensity distribution map image representation may be estimated with real time response. If a real fire occurs in the cargo bay, the signals continue to be detected by sensor 1 and, for example, its neighbor sensors 2 and 3. The NSDP may continue to receive those signals and correct the initial smoke/fire distribution by using actual hazard signals in real time. Depending on the mission requirements, the real time may include completion of the CFD processing in less than ten seconds, less than one-half minute, or less than one minute.

Finally, a smoke/fire map image generated by the NSDP from detected smoke/fire signals may be presented on a display, as a map image representation of hazard conditions in the cargo hold, on the flight deck which allows the flight crew to confirm if there is a real fire and to proceed with proper actions, including an automatic link to or activation of fire suppression and/or other safety systems.

Figure 2:
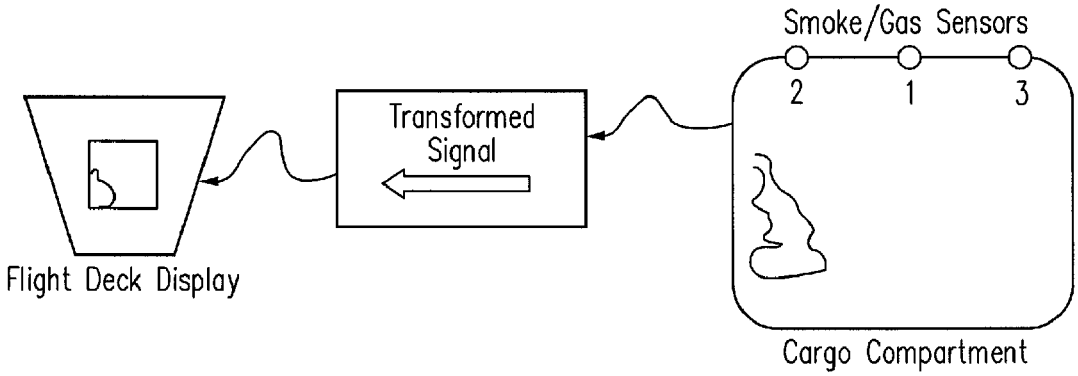
FIG. 2 shows an exemplary representation of the transformation of detected sensor signals to a visualization of hazard status in an enclosable space, in accordance with one or more embodiments of the invention.

FIG. 2 shows an exemplary representation of how signals acquired by sensors in the cargo hold (after processing) provide a visualization of status to a flight deck display. The visibility in a fully loaded cargo hold may be restricted to very narrow gaps between containers and the ceiling and walls. In the early stages of a fire hazard smoke may at first develop slowly, and visual monitoring of the slowly changing environment, especially in narrow gaps not observable by visual monitoring, may result in the possibility of missing relatively small amounts of smoke within such gaps. Therefore, a multi-sensor array may be beneficial.

Figure 3:
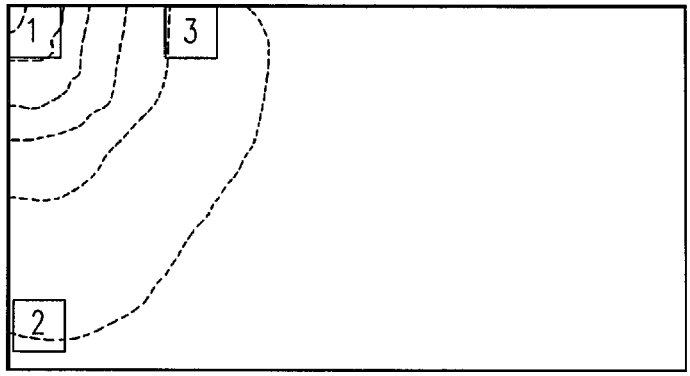
FIG. 3 shows an exemplary map image representation produced by a numerical sensor data processor (NSDP) that may be displayed on a monitor, as derived from a multi-sensor array as in FIG. 1.
Figure 4:
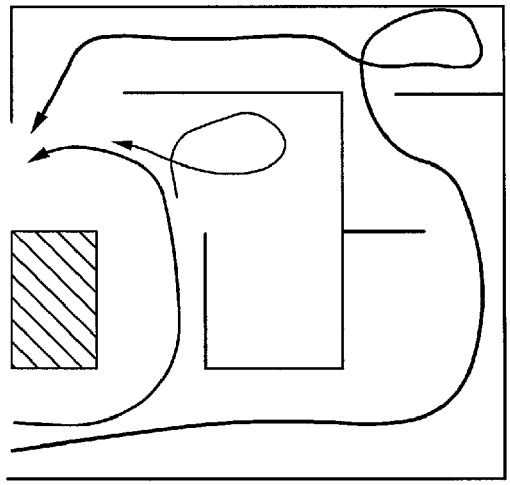
FIG. 4 shows an exemplary display of predicted flow of gases or smoke that may be computed using a computational fluid dynamics (CFD) based NSDP on a graphical processing unit (GPU).

The calculated smoke/fire map image representations may be one, two or three dimensional, evolve in time and indicate predicted direction and rate of flow. The NSDP may be capable of computing and providing a map image representation of various hazard features (e.g., smoke, fire, temperature, gases) with a computed spatial resolution finer than the disposition of the sensor array. FIG. 3 shows an exemplary map image representation of, for example, temperature isotherms, smoke concentrations, and their gradients, produced by the NSDP that may be displayed on a monitor, as derived from a multi-sensor array as in FIG. 1. FIG. 4 shows an exemplary predicted flow of gases or smoke that may be computed using a CFD-based NSDP on a GPU for a enclosable space with complex geometry and two access ports.

Figure 5:
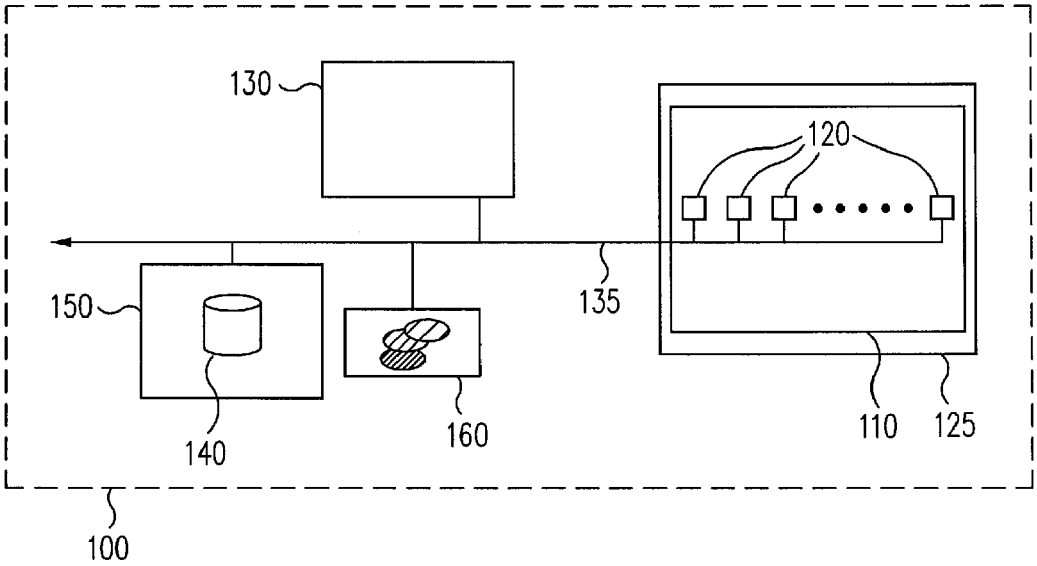
FIG. 5 shows an exemplary smoke and fire detection system, in accordance with one or more embodiments of the invention.

FIG. 5 shows an exemplary smoke and fire detection system 100, in accordance with one or more embodiments of the invention. A multi-sensor system 110 may include one or more sensors 120 and may be disposed in an enclosable space 125. At least one sensor 120, or a plurality of sensors 120 may be responsive to a variety of environmental features, such as smoke, combustible gas products, temperature, aerosols, particulates, and each sensor 120 may produce at least one environmental feature signal based on the detected environmental feature. Additionally, some sensors 120 may include thermal imaging and visual imaging sensor subsystems that acquire and process images for thermal, motion or visibility data.

Alternatively, some sensors may include conventional video cameras to provide unmodified real-time video imagery of the enclosable space 125, enabling a viewer to observe the presence and location of smoke and flames, or to get a sense of visibility. The signals produced by sensors 120 representing the environmental feature data may be transmitted over a communications channel 135.

Communications channel 135 may represent a wired and/or a wireless communications link, which may provide communications service to many functional hardware systems. Attached to communications channel 135 may be a general purpose computing system 130. Computing system 130 may be configured to support general processing, storage, and input/output (I/O) functions.

The signals produced by sensors 120 may be transmitted via communications channel 135 to a computational processing platform that may be a GPU 150. GPU 150 may serve as a "host" (e.g., a computing platform) for a hosted function 140 application program. Hosted function 140 may include a CFD algorithm for processing and transforming data from sensors 120. GPU 150 may transform the information from sensors 120 into a graphical map image representative of the sensed environmental features within enclosable space 125. GPU 150 may be capable of rapid rendering of the representational map image and any associated alphanumeric information, which may then be provided to a display 160 via communications channel 135. In accordance with the embodiment of the invention just described, GPU 150 may be referred to as a line replaceable unit (LRU), a term common in the aerospace industry. LRUs may interface with other devices via communications channel 135.

In accordance with an embodiment of the invention, alternative configurations of smoke and fire detection system 100 may be used. For example, GPU 150 may be configured as a card operational within computing system 130 via an internal communications bus. Hosted function 140 may then be stored in a memory portion of processing computer 130 or, alternatively, may be stored directly in memory in GPU 150.

In accordance with another embodiment of the invention, GPU 150 may interface directly with display 160, which may provide real time response that may be more effective than interfacing via communications channel 135, which may require communications protocols that increase time delay.

Various other configurations of distributed computing functionality are considered to be within the scope of the invention. Although the above description includes a GPU 150, embodiments of the invention may also include any processor design or architecture in place of GPU 150 that provides for highly parallel or high speed numerical processing of data to satisfy the requirement of presenting and updating the hazard status in substantially real time.

For example, the real time interval for display and update of the graphical image may include any time interval between zero seconds (i.e. substantially instantaneous) and one minute, but preferably ten seconds or less that about one-half minute in order to provide a margin of time for computing updates. A time increment for updating the graphical image should be as short as possible, within the limits of the architecture of the computational algorithm and the computing platform chosen. Any beneficial reduction in time to expeditiously provide an image representing the smoke/fire condition in the enclosable space 125 supports a more rapid mitigation of the detected hazard.

Hosted function 140 may include an algorithm implementation of CFD technology adapted to both suit the special advantages of GPU 150 and incorporate rapid convergence routines. Hosted function 140 may define current and predicted spatial and time dependent values of various fire and smoke related parameters, and the flow velocity of these parameters to evaluate the rate and direction of spread of the hazard.

CFD may include the use of computers to analyze time and spatially dependent problems in fluid dynamics, which also may include smoke and/or gases, as well as thermodynamic properties, including fire driven buoyancy flow. A fundamental consideration in CFD is how one efficiently treats a continuous fluid in a discretized manner on a computer. It is understood that instructions may be executed on the computer processor to retrieve, manipulate, and store information. In general, the approach may discretize the spatial domain into small cells to form a volume mesh or grid, of finite volume (finite difference), and then apply a suitable algorithm to solve the equations of motion over time. This provides a predicted "map" of finer detail than that which is provided by the sensor array only. In this manner, a finite difference or finite volume approach is used for both a structured or an unstructured grid for flow field simulation.

Various CFD methods may include direct numerical simulation (DNS), Reynolds-Averaged Navier-Stokes (RANS) equation modeling, large eddy simulation (LES), and various subsets of these that may include a subgrid scale model or the turbulent viscosity models. Some methods may require a fine grid of finite volumes, with the result that processing time may become prohibitively long and preclude real time updating. The simplest and most cost effective turbulence models may be zero-equation (ZE) models. Once calibrated, ZE models may reasonably predict the mean-flow quantities.

However, typical CFD algorithms, being often concerned with the time-dependant evolution of heat and gas flow in three dimensions, require large computing resources and processing time to provide an accurate representation of the expected distribution of fire related properties. Therefore, in accordance with one or more embodiments of the invention, numerical approximation methods of CFD may be used to efficiently analyze sensor data and take advantage of the architecture of the computing system. When combined with a multi-sensor system and specialized computing processors, such as, for example, parallel processors, this is referred to, as described earlier, as numerical sensor data processing (NSDP).

Figure 6:
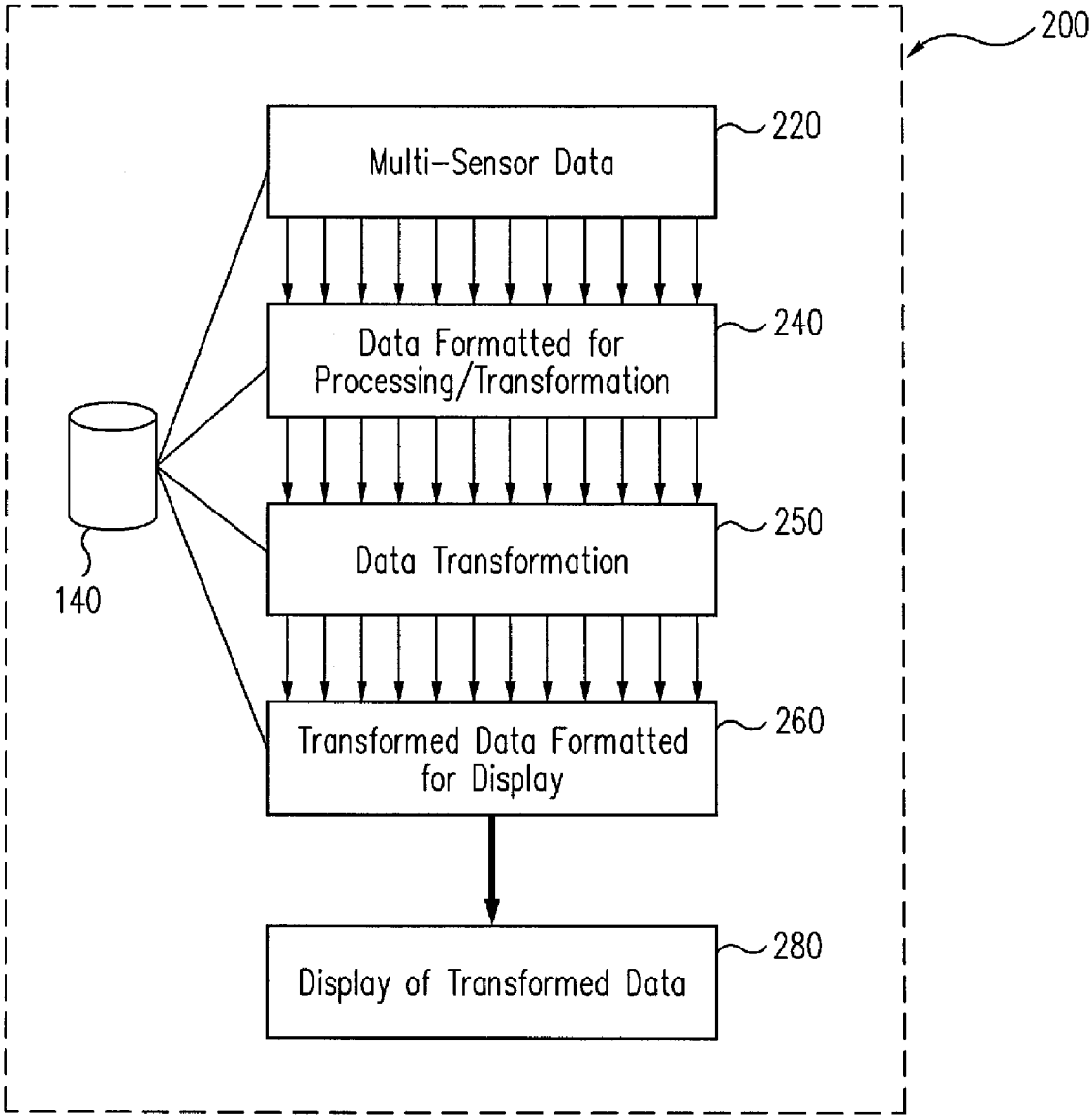
FIG. 6 is a block diagram showing an exemplary flow of data transformation from sensor data to display data, in accordance with one or more embodiments of the invention.

FIG. 6 is a block diagram showing an exemplary flow 200 of data transformation from sensor data to display data, according to one or more embodiments of the invention. Multi-sensor data 220, provided from one or more sensors, may be transferred over communications channel 135 to hosted function 140 where data manipulation and transformation takes place. Multi-sensor data 220 arriving at hosted function 140 may be formatted 240 for processing by the next computational module for transformation 250. The transformed data is provided to a display formatting transformation module 260 to provide data suited to display 160 (e.g., raster or vector). Finally, data is provided from hosted function 140 and GPU 150 to display 160 for data display 280.

A CFD-based NSDP, operating as hosted function 140 on GPU 150, may manipulate and transform data from sensors 120 to provide a graphic output to display 160 for users, such as airline crewmembers. The graphics presentation provides a map image and specifies the status of smoke, combustible gases and temperature in an enclosable space, such as the cargo hold of a commercial airliner, as well as generates a map of the flow evolution of these quantities over time within the enclosable space. Flow may be defined as the spatially dependent time rate of change of values, including velocity, of the environmental features. The graphical information of these characteristics may be presented using, for example, color-coding, intensity, grey-scale, and alphanumeric information overlays.

Figure 7:
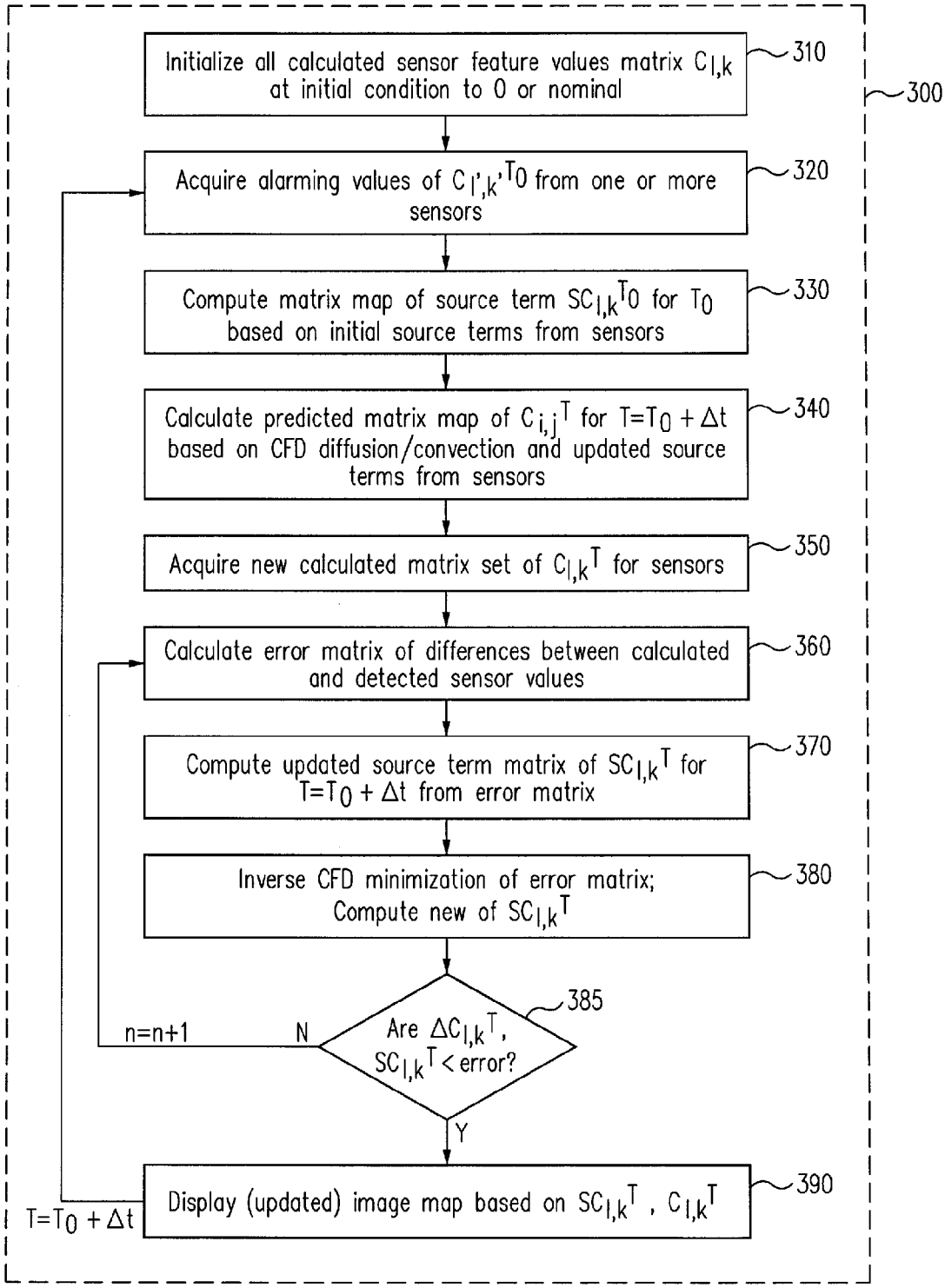
FIG. 7 shows an exemplary signal processing flow for creating a map image from sensor signals, in accordance with one or more embodiments of the invention.

FIG. 7 shows an exemplary signal processing flow 300 for creating a map image from sensor signals, according to one or more embodiments of the invention. The reader will appreciate that corresponding maps may be constructed simultaneously for temperature, combustible gas concentrations, and other environmental features by substituting appropriate sensors and applying the same procedures with appropriate coefficients in the CFD algorithms pertaining to the signals supplied by those sensors.

Upon request, including at power-up of smoke and fire detection system 100, hosted function 140 may initialize the values of all sensor environmental feature signals, or may capture an assumed non-hazardous initial state or base-line value. Subject to initial conditions where no fire hazard is detected, the values of all sensor signals will be initialized (block 310) to a nominal null set; e.g., where no fire hazard is present, and $C_{l,k}^{T=0}\approx 0$ for smoke or combustible gas concentrations, or within a nominal range of temperature values. The indices [l,k] represent, for this example, the identifier values of particular sensors 120. While sensors 120 are spatially distributed, [l,k] could be spatial location indicators, or, alternatively, in another embodiment, [l,k] could identify the lth sensor of sensor type k, with the spatial location indexed elsewhere, such as in a lookup table. $C_{l,k}^{T}$ may be regarded as source values at all sensors prior to some nominal time T=0, before which there is no alarm condition.

Using smoke concentration as a source value example, at time T=0, assume that one or more sensors l',k' detects a concentration $C_{l',k'}^{(To=0)}=C_{l',k'}^{0}$ that may be an alarming value. This value is acquired in block 320 by the hosted function 140. If $T=T_0+\Delta t$ is the first measurement index at T=0, the predicted concentration (block 330) following any time interval $T=T_0+\Delta t$ expected to be detected at any arbitrary grid location may be calculated from, $$\frac{\partial C}{\partial t}+\frac{\partial U_{i'}C}{\partial x_{j'}}=\frac{\partial}{\partial x_{j'}}\left(D\frac{\partial C}{\partial x_{j'}}\right)+SC_{l,k}, \quad [1]$$

where $$\frac{\partial U_{i'}C}{\partial x_{j'}}$$

represents a convection term, and $$\frac{\partial}{\partial x_{j'}}\left(D\frac{\partial C}{\partial x_{j'}}\right)$$

represents a diffusion term, where the suffix i' and j' rakes the value 1, 2, or 3. For a two dimensional example, such as on the ceiling section of a cargo compartment, the domain may be divided into M×N meshes, where one direction is specified by M(i=1, . . . M), and the other direction is N (j=1, . . . N). At any grid point [i,j], the smoke concentration may be calculated from CFD as $$C_{i,j}^{T}=C_{i,j}^{T-\Delta t}+\Delta t(\text{Diffusion}-\text{Convection})+SC_{l',k'}^{T-\Delta t} \quad [2]$$

where $SC_{l',k'}^{T-\Delta t}=C_{l',k'}^{To}$ is the source term of the previous concentration at $T_0=T-\Delta t$ (i.e., at the beginning of the time increment) at the sensor l',k'. Values above a preset threshold may indicate a possible fire.

The above equation calculates a distribution map (block 340) of the smoke concentration based on data from all sensors using the CFD algorithm, where all terms (except Δt) are matrices.

Following the time interval Δt, the sensors [l,k] will all generate new values (block 350) of concentration. In particular, the original sensor [l',k'] will detect a new concentration value, $C_{l',k'}^{T}$, and if it is presumed that a fire hazard is truly developing, then typically, $C_{l',k'}^{T}>C_{l',k'}^{To}$. The source term in Eq. 2 will be updated to $SC_{l',k'}^{T}$, as will be discussed below.

New predicted values of $C_{i,j}^{T}$ at the sensor location $C_{l,k}^{T}$ will be obtained from Eq. [2], and each value of calculated and measured sensor value will be compared for each sensor. The difference will be an error correction factor (block 360) of $\Delta C_{l,k}^{T}$, where $[\Delta C_{l,k}^{T}]$ is the matrix of difference values (calculated−measured) of all sensors, that is used to correct and update (block 370) the value of the source term $SC_{l'',k''}^{T}$, given by $$SC_{l''k''(n+1)}^{T}=SC_{l',k'(n)}^{T}\pm f(\alpha[\Delta C_{l,k(n)}^{T}]) \quad [3]$$

where α is a coefficient factor, and $f(\alpha[\Delta C_{l,k}^{T}])$ is a function that takes into account spatial separation between sensors. This function may be constructed by an interpolation approach between detected signals from each of the sensors.

Minimization (block 380) of the error matrix $[\Delta C_{l,k}^{T}]$ is the task of an inverse CFD procedure, which may iterate from the error minimization test (block 385) back to error matrix calculation (block 360).

With the corrected source term, a new smoke distribution may be calculated for the same time step interval and repeatedly compared with sensor data (block 360). Finally, a smoke concentration distribution and flow map image based on the sensor data is calculated and displayed (block 390). The procedure may then repeat, returning to block 320 to acquire new sensor values, and may end when hosted function 140 is terminated.

Similarly, temperature or combustible gas products, such as carbon monoxide or carbon dioxide may be detected by appropriate sensors, and temperature or other species distributions may be calculated. A combination of these distributions and the expected flow of these quantities may then be presented on display 160, allowing the flight crew to monitor and evaluate a real smoke/fire condition in the cargo holds, and take appropriate action.

Figure 8:
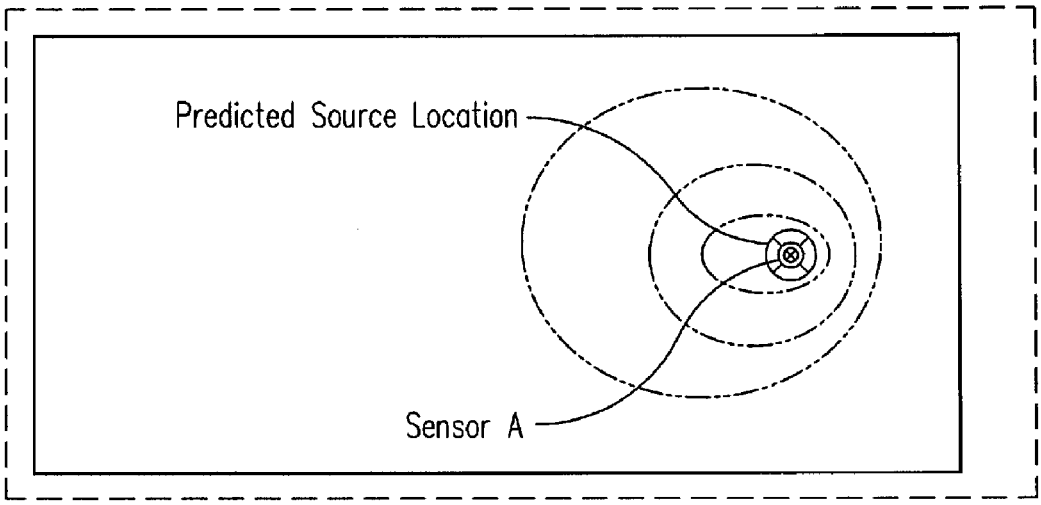
FIG. 8 shows an exemplary representation of one sensor in a two dimensional map image, in accordance with one or more embodiments of the invention.
Figure 9:
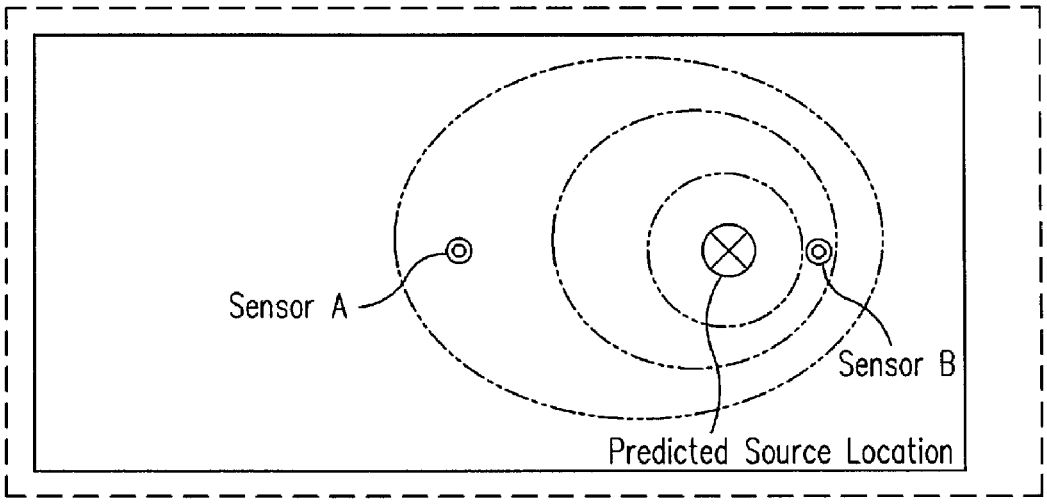
FIG. 9 shows an exemplary representation of two sensors in a two dimensional map image, in accordance with one or more embodiments of the invention.

FIG. 8 shows an exemplary representation of one sensor in a two dimensional map image, and FIG. 9 shows the case when there are two sensors, in accordance with one or more embodiments of the invention. In FIG. 8, only one sensor is disposed in an enclosable space. According to one or more embodiments of the invention, the sensor may be assumed to provide only a scalar value (i.e., having no directional information) of an environmental feature. (Directional sensors are also considered to be within the scope of the invention). Therefore, in this simple case, the sensor location is considered synonymous with the smoke source, and sensor [l,k]=(1,1] by definition. Values of $C_{i,j}^{T}$, may, for example, appear as circular equi-potentials (i.e., an equi-potential is a locus of points having the same value of smoke concentration) in the absence of a boundary. For the mesh describing the entire enclosable space with the sensor located as shown, the NSDP may provide a map image that looks asymmetric, as shown in FIG. 8, where the boundary conditions of the enclosable space have been taken into account by the CFD algorithm. A more complicated enclosable space may result in a more complicated set of $C_{i,j}^{T}$, which may provide a more complex map image. The computed source term used to construct the map image, $SC_{l'',k''}^{T}$, may continue to be collocated with the sensor location (i.e., because there is no function describing the distance between a sensor and itself, and Eq[3] is greatly simplified).

FIG. 9 shows an exemplary case using two sensors. For example Sensor A may be labeled A[l,k]=[1,1] and Sensor B may be labeled B[l,k]=[1,2], where the physical locations are listed in a lookup table accessed by the CFD algorithm. In this case the computed source term $SC_{l'',k''}^{T}$, may no longer be collocated with a sensor, and Eq. [3] takes into account the location and separation of Sensors A and B. The corresponding map image, obtained from computing $C_{i,j}^{T}$ over all points [i,j] in the mesh may appear as shown in FIG. 9.

Embodiments described above illustrate but do not limit the invention. It should also be understood that numerous modifications and variations are possible in accordance with the principles of the present invention. For example one may readily see that, alternatively, embodiments may be realized for virtually any enclosed space on vehicles or other structures to observe a developing alarm event, such as in any airborne cargo hold, a ground vehicle, a seaborne ship's cargo hold, or static spaces, such as a warehouse, a tunnel, or any room or storage space wherein a danger of fire exists including hazards due to flammable substances, materials, and/or electrical failure. Accordingly, the scope of the invention is defined only by the claims.

What is claimed is:

1. A detection system, comprising:

at least one sensor located in an enclosable environment, each sensor being configured to detect at least one environmental feature and provide a corresponding at least one environmental feature signal;

means for processing the at least one environmental feature signal and providing at least one processed feature signal, the at least one processed feature signal corresponding to a transformed at least one environmental feature signal;

a hosted function configured to provide instructions to the processing means, the hosted function comprising a computational algorithm adapted to perform numerical transformation operations based on the at least one environmental feature signal, the hosted function being configured to provide a map image representation based on the at least one processed feature signal;

wherein the instructions executed by the processing means performs a method comprising:

providing at least one prediction parameter for each environmental feature signal, each prediction parameter being used to provide a predicted map image representation according to an algorithmic processing of the at least one environmental feature signal at a time increment;

transforming a second environmental feature signal by the at least one sensor after the time increment to create a second map image representation of the environmental feature signal related to the time increment, wherein the second map image representation is used to update the map image representation; and determining at least one error difference between the second map image representation and the predicted map image representation, the at least one error difference being used to update the algorithmic processing; and means for displaying the map image representation.

2. The system of claim 1, wherein the at least one sensor comprises at least one of a smoke sensor, a combustible gas product sensor, a temperature sensor, an aerosol sensor, a particulate sensor, a thermal imaging sensor, and a visual imaging sensor.

3. The system of claim 1, wherein the processing means includes a parallel computer processor.

4. The system of claim 1, wherein the processing means includes a graphics processing unit.

5. The system of claim 1, wherein the hosted function computational algorithm includes a computational fluid dynamics model.

6. The system of claim 5, wherein the computational fluid dynamics model further comprises an algorithm for incremental time-dependent prediction of the at least one processed feature signal.

7. The system of claim 1, wherein the enclosable environment comprises one of an aircraft cargo space, a marine vessel cargo space, a land vehicle cargo space, and a fixed structure storage space.

8. The system of claim 1, further comprising:

wherein the computational algorithm is further adapted to provide a combined map image comprising the map image representation and the second map image representation; and wherein the computational algorithm includes a computational fluid dynamics algorithm adapted to compute at least one of time, position, and flow of the environmental feature signal value detected by the at least one sensor, with the computational fluid dynamics algorithm providing instructions executable by the processing means to perform a method comprising:

computing a spatial mesh grid representation of the enclosable space having a resolution finer than the spatial disposition and mapping of the at least one sensor;

computing a representation of environmental feature values at the resolution of the spatial mesh grid; and computing a predicted change in the representation of environmental features at the end of the time increment.

9. A method for communicating environmental information of an enclosable space to a flight crew in a cockpit of an aircraft comprising:

providing at least one sensor, each sensor being configured to detect at least one environmental feature and provide a corresponding at least one environmental feature signal, each sensor being disposed at a location in the enclosable space;

providing a hosted function including at least one processing instruction;

processing the at least one environmental feature signal based on the at least one processing instruction from the hosted function to provide a map image representation; and displaying the map image representation, wherein the hosted function is configured to implement a computational algorithm comprising:

transforming the first environmental feature signal to create a first map image representation of the environmental feature signal;

providing at least one prediction parameter for each environmental feature signal, each prediction parameter being used to provide a predicted map image representation according to a computational fluid dynamics algorithm processing of the at least one environmental feature signal at a time increment;

transforming a second environmental feature signal by the at least one sensor after the time increment to create a second map image representation of the environmental feature signal related to the time increment;

updating the first map image representation of the environmental feature to a second map image representation; and determining at least one error difference between the second map image representation and the predicted map image representation, the at least one error difference being used to update the computational fluid dynamics algorithm processing.

10. The method of claim 9, wherein processing the at least one environmental feature signal includes executing at least one instruction on a parallel processing computer.

11. The method of claim 9, wherein processing the at least one environmental feature signal includes executing at least one instruction on a graphical processing unit.

12. The method of claim 9, wherein the at least one sensor provides at least one of a smoke sensor environmental feature signal, a combustible gas product sensor environmental feature signal, a temperature sensor environmental feature signal, an aerosol sensor environmental feature signal, a particulate sensor environmental feature signal, a thermal imaging sensor environmental feature signal, and a visual imaging sensor environmental feature signal.

13. The method of claim 9, wherein the operation of transforming the first environmental feature signal further comprises providing a map of a spatial disposition of the at least one sensor in the enclosable space.

14. The method of claim 9, further comprising adjusting the at least one prediction parameter to minimize the error difference between the second map image predicted representation at the at least one sensor location and the updated second map image representation of the environmental feature signal.

15. The method of claim 9, further comprising:

providing a combined map image comprising the first and second map image representations; and displaying the combined map image.

16. The method of claim 9, wherein the computational fluid dynamics algorithm is adapted to compute at least one of time, position, and flow of the environmental feature signal value detected by the at least one sensor.

17. The method of claim 16, wherein the computational fluid dynamics algorithm comprises:

computing a spatial mesh grid representation of the enclosable space having a resolution finer than the spatial disposition and mapping of the at least one sensor;

computing a representation of environmental feature values at the resolution of the spatial mesh grid; and computing a predicted change in the representation of environmental features at the end of the time increment.

18. The method of claim 17, wherein the computational fluid dynamics algorithm further comprises computing a map image corresponding to a disposition and flow of the at least one environmental feature signal detected by the at least one sensor in substantially real time.

19. The method of claim 18, wherein substantially real time includes a time delay of less than a defined time increment, the defined time increment including at least one of less than ten seconds, less than one-half minute, and less than one minute.

20. A method of hazard sensing in an enclosable space, the method comprising:

determining the presence of a hazardous condition by using a numerical sensor data processing algorithm based on computational fluid dynamics configured to process a detected signal from at least one sensor disposed in the enclosable space;

creating a map image providing at least a current representation and a predicted future representation of the hazardous condition based on the numerical sensor data processing algorithm;

wherein the creating a map image further comprises:

acquiring a first data at a first time from the at least one sensor, each sensor being located at a position within the enclosable space;

associating an alarm signal value with the first data at a location of each of the one or more sensor when the acquired sensor signal value is consistent with an alarm condition;

computing a sensor signal source term associated with the at least one sensor;

computing at least one predicted value and a predicted time flow of the at least one sensor signal value for a time increment;

acquiring a second data from the at least one sensor, the second data being acquired at a second time after the time increment;

computing an error difference between each of the detected and predicted sensor signal values;

computing an updated predicted sensor signal source term associated with each one or more sensors based on the error differences;

applying a minimization routine to the error differences to compute a second error difference; and providing an output for display of a map image representative of the hazardous condition and the predicted sensor signal time flow values, when the second error difference is below a first error threshold; and displaying the map image on a display.

21. The method of claim 20, wherein the numerical sensor data processing algorithm is configured for execution on a graphics processing unit.

22. The method of claim 20, wherein the providing an output further comprises:

computing a mesh grid representation of the enclosable space having a resolution finer than the spatial disposition of the at least one sensor;

computing a representation of at least one environmental feature value associated with the at least one signal detected by at the at least one sensor at the resolution of the spatial mesh grid; and computing a predicted change in the image map representation of the at least one environmental feature value over a time increment.

23. The method of claim 20, further comprising repeating one of an acquiring and computing operation until the error differences are below a second error threshold.

* * * * *